US005757171A

United States Patent [19]

Babcock

[11] Patent Number: 5,757,171

[45] Date of Patent: May 26, 1998

[54] ON-BOARD VOLTAGE REGULATORS WITH AUTOMATIC PROCESSOR TYPE DETECTION

[75] Inventor: Sean Babcock, Portland, Oreg.

[73] Assignee: Intel Corporation, Santa Clara, Calif.

[21] Appl. No.: 802,076

[22] Filed: Dec. 31, 1996

[51] Int. Cl.[6] ..... G05F 1/40

[52] U.S. Cl. ..... 323/271; 323/285; 395/750.01; 361/764

[58] Field of Search ..... 364/948.6, 948.4; 395/750.01, 750.08; 363/147, 65, 74; 361/736, 764, 760, 781, 780, 794, 777; 174/255, 261; 323/271, 283, 285

[56] References Cited

U.S. PATENT DOCUMENTS 4,992,970 2/1991 Igarashi ..... 364/483

5,384,692 1/1995 Jaff ..... 361/807

5,587,887 12/1996 Price et al. ..... 361/794

*Primary Examiner*—Peter S. Wong

*Assistant Examiner*—Shawn Riley

*Attorney, Agent, or Firm*—Kenyon & Kenyon

[57] ABSTRACT

An embodiment of the present invention provides a voltage comparator that senses the type of processor, unified or split voltage plane coupled to a mother board. Under the control of at least one multiplexer, voltage regulators supply voltage to the processor. If the processor is a unified voltage plane type, the voltage regulators are coupled together in a master/slave configuration to supply a single voltage to the processor. If the processor is a split voltage plane type, the voltage regulators are coupled to together in a master/master configuration where a core voltage regulator supplies a core voltage to the processor, and an I/O voltage regulator supplies an I/O voltage to the processor. This will allow each regulator to be set at a different voltages to accommodate processor types with different core and I/O voltages.

24 Claims, 3 Drawing Sheets

ON-BOARD VOLTAGE REGULATORS WITH AUTOMATIC PROCESSOR TYPE DETECTION

BACKGROUND OF THE INVENTION

The present invention relates generally to the field of voltage regulation for computer mother boards, and in particular to an on-board voltage regulator capable of automatically detecting the voltage plane type of an installed processor and adjusting its voltage regulation accordingly.

In general, the term "mother board" refers to the master chassis of a computer. A mother board typically includes a number of connectors for enabling various components of the computer (such as a CPU (Central Processing Unit) or other processor, a chipset (e.g., an 82430 or 82440 series chip set designed and manufactured by Intel Corporation, Santa Clara, Calif.), a cache memory, and a clock generator) to communicate with one another over a bus. A goal of mother board designers has been to provide maximum flexibility with respect to the types of components that can be installed in the mother board without having to physically alter the board in any way.

Processors which are typically installed in a mother board are of two types: unified voltage plane (UVP) processors and split voltage plane (SVP) processors. An example of a UVP processor is a Pentium® processor (model #P54 CTA), and an example of an SVP processor is a Pentium® processor MMX (model #P55C) (both designed and manufactured by Intel Corporation). Both types of processors include two voltage planes—a core voltage plane and an I/O (Input/Output) voltage plane—each of which must be regulated. A flexible mother board should ideally support either type of processor interchangeably, and thus should make allowance for the differing voltage regulation requirements of UVP and SVP processors.

Known mother boards capable of using both UVP and SVP processors have two distinct processor power planes built into the board, designated the processor core voltage plane and the processor I/O voltage plane. Examples of such mother boards include model nos. TC430HX and RU430HX manufactured by Intel Corporation. The processor I/O voltage plane may serve other components on the board in addition to the processor, such as the chipset, the cache memory, and the clock generator.

In a UVP processor, the core voltage plane and the I/O voltage plane are coupled inside the chip on which the processor is implemented, thereby enabling a single voltage regulator to power both the mother board core and the I/O voltage planes with the same voltage. By contrast, an SVP processor has a core voltage plane and an I/O voltage plane that are separately coupled to the corresponding voltage planes on the mother board. In other words, unlike a UVP processor, the two voltage planes are not coupled to one another inside the processor. Moreover, the two voltage planes of an SVP processor may likely require two different voltages. The SVP configuration thus requires two separate voltage regulators on the mother board to supply voltage to the core and I/O voltage planes independently.

There are at least two known approaches for supplying voltage to both UVP and SVP processors used in typical mother boards. The first approach requires the use of a physical connect/disconnect of the core and I/O voltage planes on the mother board. For a UVP processor, the respective voltage planes on the mother board are connected by jumpers or low ohm resistors so that a single regulator can supply a single voltage to the unified voltage plane. For an SVP processor, these jumpers or low ohm resistors are removed to provide separate core and I/O voltage planes. A significant disadvantage of this approach is that the user must physically manipulate the mother board power planes depending upon which type of processor is used. For example, if zero ohm resistors are used to connect the mother board power planes, they must be soldered in place (and thus can only be removed by the same method). The requirement for physical manipulation of the mother board also creates a risk of processor damage due to user error if, for example, the jumpers are incorrectly installed for a given processor type. In short, this is not a flexible approach. Once the mother board is configured to work with a particular type of processor, it is for all intents and purposes a single processor type mother board.

The second known approach for supplying voltage to both UVP and SVP processors is likewise deficient. Unlike in the first approach, the core and I/O voltage planes are not connected to one another on the mother board. The mother board is by default configured for an SVP processor. To then convert the mother board for use with a UVP processor, the respective voltage planes of the mother board are coupled inside the processor package. A single voltage is supplied to the core voltage plane on the mother board, and the I/O voltage plane on the mother board is then supplied through the lead frame of the processor. This approach does not involve any user- or factory-configurable jumpers or resistors, thus eliminating at least some of the problems of the preceding approach; however, since the power to the processor's I/O voltage plane (and possibly the rest of the mother board) is supplied through the lead frame of the processor, the predetermined specifications of the processor may be violated. Even if it is specified that power is to be run through the lead frame, the system requirements may exceed those set forth in the specification. Processor manufacturers typically do not sanction using the lead frame of a processor to power its own I/O components and/or other components on a mother board.

In view of the deficiencies of known approaches to interchangeably supporting multiple processor types on a single mother board, there is a need for a flexible mother board capable of detecting what type of processor is installed and automatically configuring itself to supply power to the processor in an appropriate manner. For example, a flexible mother board should ideally be capable of determining whether an installed processor is: (1) a UVP processor, in which case the mother board would automatically configure itself to power both the core and I/O voltage planes together; or (2) an SVP processor, in which case the mother board would automatically configure itself to power the core and I/O voltage planes separately. No such flexible mother board currently exists.

SUMMARY OF THE INVENTION

According to an embodiment of the present invention, an automatic plane sensing voltage regulator is provided for automatically configuring a computer mother board to power a processor installed thereon. In this embodiment, the processor is either a unified voltage plane processor or a split voltage plane processor, and the computer mother board has a core voltage plane and an I/O voltage plane. The automatic plane sensing voltage regulator includes a voltage comparator which receives as inputs a voltage across an I/O voltage plane and a core voltage plane of the mother board. The comparator generates a first signal indicating a type of processor coupled to the mother board (i.e., a unified voltage plane processor or a split voltage plane processor). This first signal is supplied to a multiplexer which in turn controls core and I/O voltage regulators supplying voltage to the processor in dependence on the type of processor that is coupled to the mother board.

DETAILED DESCRIPTION

Figure 1:
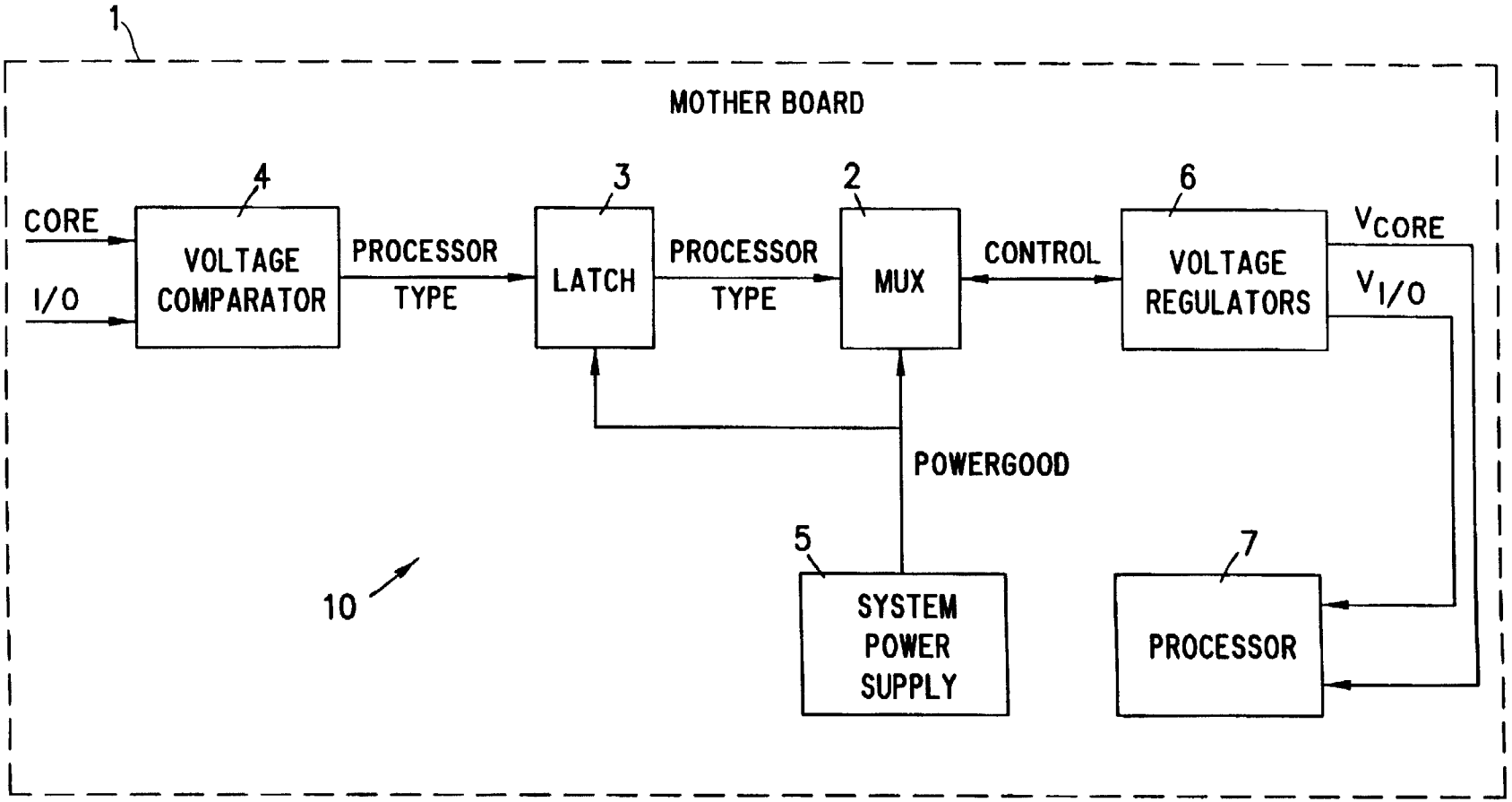
FIG. 1 is a block diagram illustrating an automatic plane sensing voltage regulator according to an embodiment of the present invention.

Referring now to FIG. 1, according to an embodiment of the present invention a mother board 1 capable of automatically configuring itself to operate with either an SVP or UVP processor includes an automatic plane sensing voltage regulator 10. Automatic plane sensing voltage regulator 10 includes a voltage comparator 4 receiving as inputs, signals from the mother board "core" voltage plane and the mother board "I/O" voltage plane. Voltage comparator 4 determines the type of processor (e.g., UVP or SVP) coupled to mother board 1 and outputs a first signal "Processor Type" to a first latch 3 (e.g., a 7474 chip by National Semiconductor Corp., Santa Clara, Calif.). Latch 3 outputs the Processor Type signal to a multiplexer (MUX) 2 which also receives a second signal, a "Powergood" signal, from the system power supply 5. MUX 2 controls voltage regulators 6 which supply voltage ($V_{core}$ and $V_{I/O}$) to a processor 7.

Figure 2:
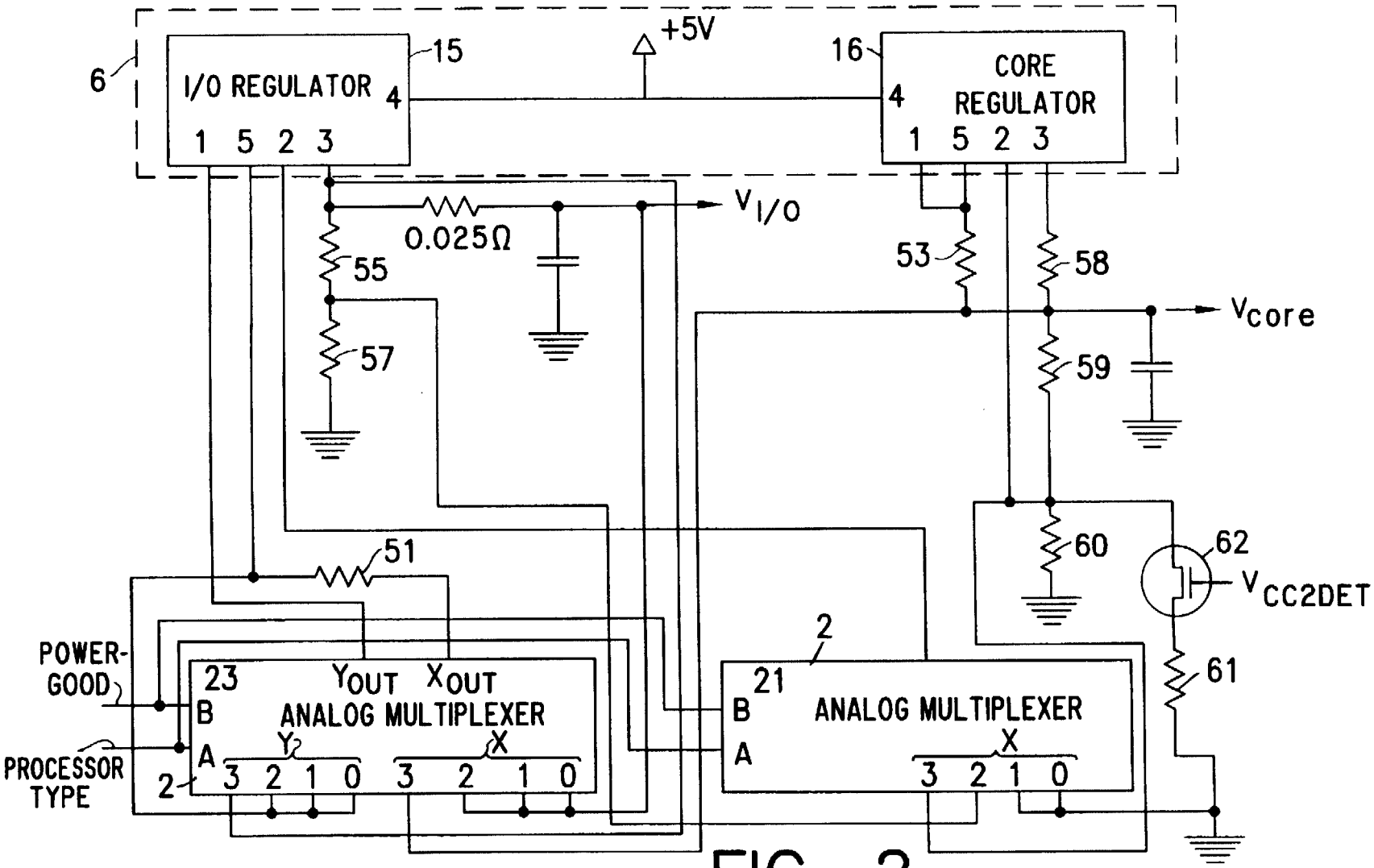
FIG. 2 is a schematic illustrating in greater detail part of a voltage regulator for use in the embodiment illustrated in FIG. 1.
Figure 3:
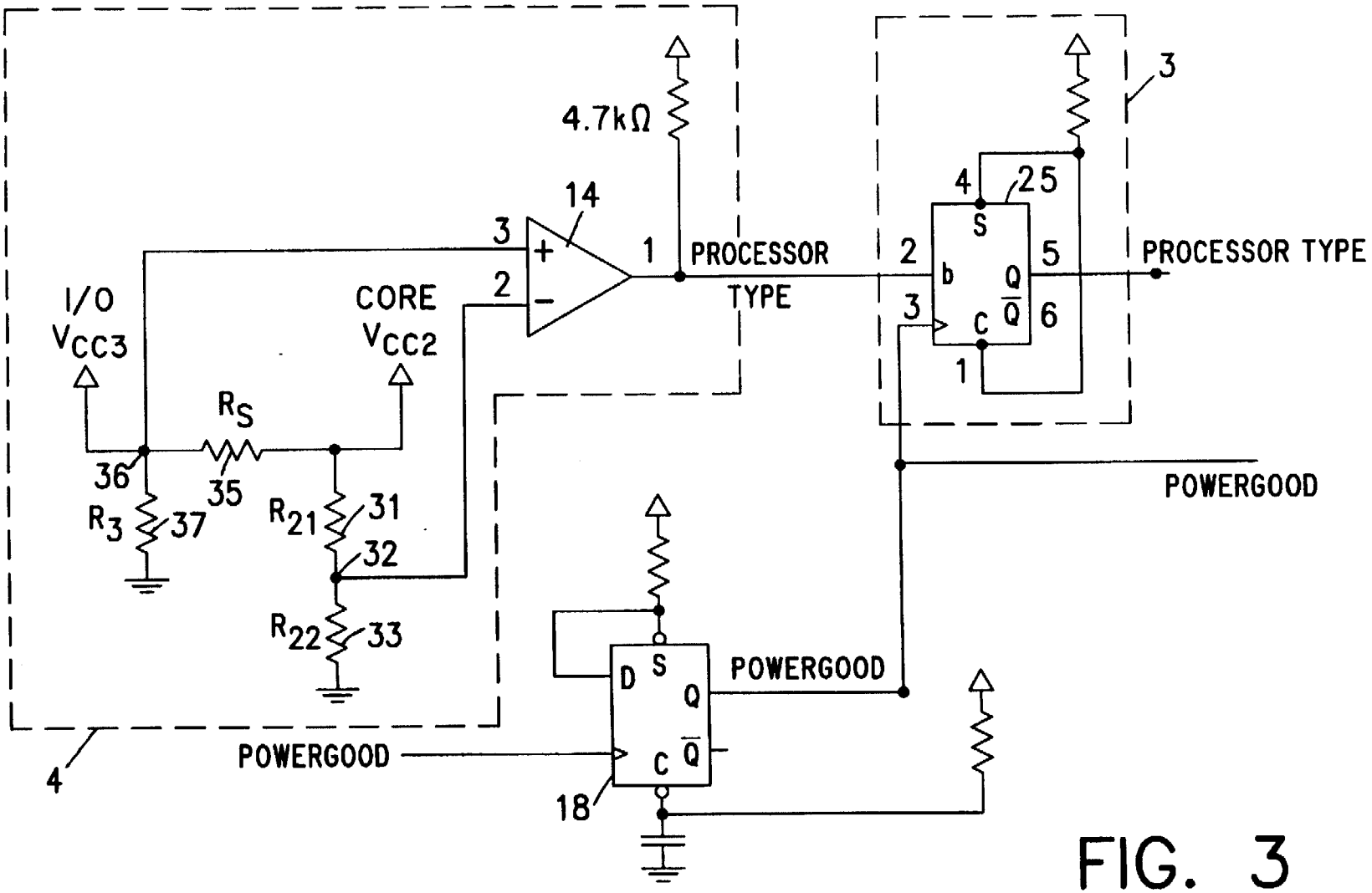
FIG. 3 is a schematic illustrating in greater detail another part of a voltage regulator for use in the embodiment illustrated in FIG. 1.

A more detailed embodiment of the automatic plane sensing voltage regulator 10 of the present invention is shown in FIGS. 2 and 3. Referring to FIG. 2, voltage regulators 6 of FIG. 1 comprise an I/O regulator 15 and a core regulator 16, each of which can be linear voltage regulators (e.g., an LT1087 chip by Linear Technology Corp., Milpitas, Calif.; and an EZ1087 chip by Semtech Corp., Newbury Park, Calif.). I/O regulator 15 and core regulator 16 are configured to be set in either a master/slave or master/master configuration by analog multiplexers 21 and 23 (e.g., model no. CD4052 by National Semiconductor, Santa Clara, Calif.). Referring to FIG. 3, analog multiplexers 21 and 23 are in turn controlled by the "Powergood" signal, latched in a second latch 18, from a system power supply (see FIG. 1) and an output of digital latch 25. Digital latch 25 holds the state of a voltage comparator 14 which controls whether I/O regulator 15 and core regulator 16 are in a master/slave or master/master configuration.

Voltage comparator 14 senses the voltage drop between the mother board core and I/O voltage planes, designated as Vcc2 and Vcc3, respectively. The voltage drop between core and I/O planes is coupled to the non-inverting input of comparator 14 and is compared to a voltage reference coupled to the inverting side of voltage comparator 14. The voltage reference is determined by the ratio of two resistors 31 (e.g., 1 Kohm) and 33 (e.g., 10 Kohm) in series between Vcc2 and ground. The voltage at the junction 32 of resistors 31 and 33 is the reference voltage. This reference voltage is set above the reference voltage of I/O regulator 15 (which is 1.25V in this exmple). Vcc2 is coupled to ground through resistors 35 (e.g., 10 Kohms) and 37 (e.g., 10 Kohms) in series. The junction point 36 of these two resistors is coupled to Vcc3 and to the non-inverting input of comparator 14. If the voltage Vcc3 from the I/O plane is greater than the voltage reference, the processor is a unified plane type and has shorted the two planes. The voltage comparator 14 will drive its output high and this will be latched in latch 25 by the Powergood signal, after that signal is latched into latch 18. If the voltage Vcc3 detected on the I/O plane is less than the reference voltage, the processor is of the split plane type and has not shorted the planes together. The voltage comparator 14 will drive its output to a low state and this will be latched in latch 25 by the Powergood signal, again, after that signal is latched into latch 18, to control analog multiplexers 21, 23 (See FIG. 2). Initially, however, both latches will be reset and in a low or "0" state. A truth table for latches 18, 25 and multiplexers 21, 23 is as follows:

| Powergood (B) | Processor Type (A) | MUX SEL | |
|---|---|---|---|
| 0 | "Don't Care" | 0, 1 | POWER ON |
| 1 | 0 | 2 | SPLIT |
| 1 | 1 | 3 | UNIFIED |

The numbers 0, 1, 2, and 3 in the column "MUX SEL" indicate which of the inputs of each multiplexer section is provided to its output.

Initially, when power is applied to mother board 1, voltage regulators 6 will be set with core regulator 16 supplying the correct core voltage, $V_{CORE}$ (e.g., 3.3 Volts) and the I/O regulator 15 supplying its lowest voltage, $V_{I/O}$, of 1.25V. Referring to FIG. 2, with Powergood having a "0" value, the $X_{OUT}$ output of MUX 21 will be the ground input at inputs $X_0$ and $X_1$ of multiplexer 21 which is input to the reference voltage input pin, pin 2, of I/O regulator 15. This causes I/O regulator 15 to supply its lowest voltage as $V_{I/O}$ at pin 3. When the reference voltage pin, pin 2, has an input of 0 volts, the output voltage will equal the reference voltage of the regulator (e.g., 1.25 volts in this example). At this time, regulators 15, 16 will be in the master/master mode. If the processor is a unified plane type, the core voltage minus a drop due to processor package resistance will be driven onto the I/O plane and the I/O regulator 15 will shut down. This voltage will be coupled through multiplexer 23 from its $X_0$ pin to $X_{OUT}$ (since Powergood still has a "0" value). This X output is the input to pin 5 of I/O regulator 15. Pin 5 is also coupled back through the $Y_0$, $Y_1$, and $Y_2$ inputs of multiplexer 23 to $Y_{OUT}$ and then to pin 1 of I/O regulator 15. Voltage comparator 14 (see FIG. 3) will detect this state and drive a logic high to the input of latch 25.

If processor 7 is of a split-voltage plane type then the I/O voltage will remain at 1.25 V and voltage comparator 14 will drive a logic low to latch 25. When the Powergood signal from the system power supply rises to a logic high indicating that the system voltages are at valid states, this value is latched into latch 18. The output of latch 18 then causes the output of voltage comparator 14 to be latched in latch 25. Together, these two latch outputs determine the appropriate configuration of the voltage regulators in accordance with the truth table set out above. After the Powergood signal is activated, the system will come out of reset and begin normal operation.

In the case of a split configuration (with the Processor Type and Powergood signals having a "1" value), inputs $X_3$ and $Y_3$ would be provided to the respective multiplexer outputs. Thus, through multiplexer 21, the reference input at pin 2 of I/O regulator 15 is the same as the input to pin 2 of core regulator 16. Thus, I/O regulator 15 is slaved to core regulator 16. The output (pin 3) of I/O regulator 15 is fed back, through multiplexer 23 to its pins 1 and 5 over the path which includes resistor 51 just as the output voltage of regulator 16 is fed back to its input pins 1 and 5 through resistor 53 (e.g., 1 Kohm).

In the case of a unified voltage plane configuration (with the Powergood signal having a "1" value and the Processor Type signal having a "0" value), the $X_2$ and $Y_2$ inputs are provided to the outputs of the multiplexers 21 and 23. Now, the reference input to I/O regulator 15 will be the reference voltage developed at the junction of resistors 55 (e.g., 1.37 Kohms) and 57 (e.g., 2.49 Kohms) coupled between the output pin 3 of regulator 15 and ground. This causes regulator 15 to operate independently. In this case the output voltage $V_{I/O}$ is fed back, through multiplexer 23 to the input pins 1 and 5 of regulator 15 in the same manner as described above.

Protection is provided to insure that once power has been applied and the configuration latched, only a power down/power up sequence can latch a new configuration state. This is achieved in that the Processor Type signal input to multiplexers 21, 23 cannot be changed until the Powergood signal has been changed to a "0" value and back to a "1" value (i.e., through a power down/power up sequence).

The output voltage of core regulator 16 can be varied by changing the voltage input to reference voltage input pin 2 using the circuit shown in FIG. 2. The signal $V_{CC2DET}$ is supplied by the Pentium® Processor MMX described above and is used to indicate a change in core voltage. When $V_{CC2DET}$ is high (i.e., at a "1" level), the P-channel FET (field-effect transistor) 62 is turned off and resistors 58 (e.g., 0.025 Ohms), 59 (e.g., 1.37 Kohms), and 60 (1.0 Kohms) control the reference voltage for core regulator 16. When $V_{CC2DET}$ is low (i.e., at a "0" level"), FET 62 is turned on adding resistor 61 (e.g., 266 Ohms) to the circuit. Now resistors 58, 59, and the parallel value of resistors 60 and 61 set the reference voltage of core regulator 16. The parallel resistance value of resistors 60 and 61 is different from the value of resistor 60 so the reference voltage changes in the two cases.

The foregoing is a detailed description of particular embodiments of the present invention as defined in the claims set forth below. The invention embraces all alternatives, modifications and variations that fall within the letter and spirit of the claims, as well as all equivalents of the claimed subject matter.

What is claimed is:

1. An automatic plane sensing voltage regulator for automatically configuring a computer mother board to power a processor installed on said motherboard via an I/O regulator and a core regualator, the processor being either a unified voltage plane processor or a split voltage plane processor, and the computer mother board having a core voltage plane and an I/O voltage plane, comprising:

a voltage comparator receiving as inputs a voltage across an I/O voltage plane and a core voltage plane of a mother board, said comparator determining a type of processor coupled to said mother board being one of a unified voltage plane processor or a split voltage plane processor;

a multiplexer controling said voltage regulators to supply power to said processor in dependence on said type of processor coupled to the mother board.

2. The apparatus of claim 1 wherein when said processor is a unified voltage plane processor, said voltage regulators supply a single voltage to said processor.

3. The apparatus of claim 2 wherein said core regulator supplies the core voltage to said core voltage plane and said I/O regulator supplies its lowest voltage to said I/O voltage plane prior to said voltage comparator receving as inputs the voltage across the I/O voltage plane and the core voltage plane of the mother board.

4. The apparatus of claim 3 wherein said I/O regulator and said core regulator are linear voltage regulators.

5. The apparatus of claim 1 wherein when said processor is a split voltage plane processor, said core regulator supplies a core voltage to said processor and said I/O regulator supplies an I/O voltage to said processor.

6. The apparatus of claim 5 wherein said core regulator supplies the core voltage to said core voltage plane and said I/O regulator supplies its lowest voltage to said I/O voltage plane prior to said voltage comparator receving as inputs the voltage across the I/O voltage plane and the core voltage plane of the mother board.

7. The apparatus of claim 6 wherein said core regulator and said I/O regulator are linear voltage regulators.

8. The apparatus of claim 1 further comprising:

a first latch coupled between said voltage comparator and said multiplexer, said first latch receiving said first signal as an input and outputting said signal to said multiplexer;

a system power supply coupled to said multiplexer and said first latch, said system power supply generating a second signal indicating that voltages across the I/O voltage plane and the core voltage plane of said mother board are at valid states.

9. The apparatus of claim 4 further comprising:

a first latch coupled between said voltage comparator and said multiplexer, said first latch receiving said first signal as an input and outputting said signal to said multiplexer;

a system power supply coupled to said multiplexer and said first latch, said system power supply generating a second signal indicating that voltages across the I/O voltage plane and the core voltage plane of said mother board are at valid states.

10. The apparatus of claim 7 further comprising:

a first latch coupled between said voltage comparator and said multiplexer, said first latch receiving said first signal as an input and outputting said signal to said multiplexer;

a system power supply coupled to said multiplexer and said first latch, said system power supply generating a second signal indicating that voltages across the I/O voltage plane and the core voltage plane of said mother board are at valid states.

11. The apparatus of claim 8 further comprising:

a second latch receiving said second signal as an input, said second latch coupled to said first latch such that said second signal latches the first signal at said first latch.

12. The apparatus of claim 9 further comprising:

a second latch receiving said second signal as an input, said second latch coupled to said first latch such that said second signal latches the first signal at said first latch.

13. The apparatus of claim 10 further comprising:

a second latch receiving said second signal as an input, said second latch coupled to said first latch such that said second signal latches the first signal at said first latch.

14. A method of automatically configuring a computer mother board to power a processor installed on said mother board via an I/O regulator and a core regulator, the processor being either a unified voltage plane processor or a split voltage plane processor, and the computer mother board having a core voltage plane and an I/O voltage plane, the method comprising:

sensing a voltage across an I/O voltage plane and a core voltage plane of a mother board;

generating a first signal indicating a type of processor coupled to said mother board being one of a unified voltage plane processor or a split voltage plane processor;

supplying said first signal to a multiplexer; and controlling said core and I/O regulators in supplying power to said processor with said multiplexer in dependence on said type of processor coupled to the mother board.

15. The method of claim 14 wherein when said processor is a unified voltage plane processor, and said core regulator is coupled to said I/O regulator in a master/slave configuration via said multiplexer and supply a single voltage to said processor.

16. The method of claim 15 further comprising:

supplying a core voltage to the core voltage plane of said mother board by said core regulator prior to said sensing step; and supplying a lowest voltage of said I/O regulator to the I/O voltage plane of said mother board before said sensing step.

17. The apparatus of claim 14 wherein when said processor is a split voltage plane processor, said core regulator is coupled to said I/O regulator in a master/master configuration via said multiplexer and said core regulator supplying a core voltage to said processor, and said I/O regulator supplying an I/O voltage to said processor.

18. The method of claim 17 further comprising:

supplying a core voltage to the core voltage plane of said mother board by said core regulator prior to said sensing step; and supplying a lowest voltage of said I/O regulator to the I/O voltage plane of said mother board before said sensing step.

19. The method of claim 14 wherein in said supplying step said first signal is supplied to the multiplexer via a first latch, the method further comprising:

generating a second signal at a system power supply coupled to said multiplexer and said first latch, said second signal indicating that voltages across the I/O voltage plane and the core voltage plane of said mother board are at valid states.

20. The method of claim 16 wherein in said supplying step said first signal is supplied to the multiplexer via a first latch, further comprising:

generating a second signal at a system power supply coupled to said multiplexer and said first latch, said second signal indicating that voltages across the I/O voltage plane and the core voltage plane of said mother board are at valid states.

21. The method of claim 18 wherein in said supplying step said first signal is supplied to the multiplexer via a first latch, further comprising:

generating a second signal at a system power supply coupled to said multiplexer and said first latch, said second signal indicating that voltages across the I/O voltage plane and the core voltage plane of said mother board are at valid states.

22. The method of claim 19 further comprising:

receiving said second signal at a second latch; and supplying said second signal to latch said first signal at said first latch.

23. The method of claim 20 further comprising:

receiving said second signal at a second latch; and supplying said second signal to latch said first signal at said first latch.

24. The method of claim 21 further comprising:

receiving said second signal at a second latch; and supplying said second signal to latch said first signal at said first latch.

* * * * *